US006108831A

United States Patent [19]

Lombreglia, Jr.

[11] Patent Number: 6,108,831

[45] Date of Patent: Aug. 29, 2000

[54] UNDERCOUNTER SINK AND METHOD FOR MOUNTING

[76] Inventor: Vincent Lombreglia, Jr., 538 Crest View Ter., Point Pleasant Beach, N.J. 08742

[21] Appl. No.: 09/307,444

[22] Filed: May 10, 1999

Related U.S. Application Data

[62] Division of application No. 09/008,653, Jan. 20, 1998, abandoned.

[51] Int. Cl.[7] ..... E03C 1/33

[52] U.S. Cl. ..... 4/631; 4/649; 29/466; 29/525.02; 29/525.11

[58] Field of Search ..... 4/631, 632, 634, 4/635, 636, 643, 648, 649; 29/466, 525.02, 525.11; 312/140.4

[56] References Cited

U.S. PATENT DOCUMENTS 429,028 5/1890 Gaghan ..... 4/649

FOREIGN PATENT DOCUMENTS 1353868 5/1974 United Kingdom ..... 4/649
2224648 5/1990 United Kingdom ..... 4/632
2242626 10/1991 United Kingdom ..... 4/632

*Primary Examiner*—Robert M. Fetsuga
*Attorney, Agent, or Firm*—Louis S. Gillow

[57] ABSTRACT

Methods are disclosed for mounting an undercounter sink provided with a flange by means of a removable metal collar, which is used: to precisely locate and position the sink beneath a laminated countertop: and to finish cut at the installation site the countertop aperture and the top impervious surface of the countertop to form a flush, watertight seal.

3 Claims, 3 Drawing Sheets

UNDERCOUNTER SINK AND METHOD FOR MOUNTING

This is a DIVISIONAL PATENT APPLICATION of copending Original Parent Application, Ser. No. 09/008,653, filed Jan. 20,1998, of Inventor, Vincent Lombreglia, Jr., entitled UNDERCOUNTER SINK AND METHOD FOR MOUNTING, abandoned.

BACKGROUND OF THE INVENTION

The present invention relates to countertops fitted with, undercounter sinks. More particularly, it relates to countertops fitted with undercounter sinks having good drainage properties by being so constructed and mounted that water spilled on the surface of the countertop flows into the undercounter sink.

BACKGROUND ART

The development of the housing and home remodeling industries has progressed very rapidly, including the manufacture of undercounter sinks for installation in countertops.

Countertops are made of a variety of materials, including laminated surfaces on chipboard material and made-made solid surfaces. Laminated countertops are constructed with a thin surface layer of impervious material, such as plastic, melamine, or FORMICA™ brand laminate made by the Formica Corporation, Cincinnati, Ohio. The thin surface layer is typically bonded to a wood fiber core, such as plywood, particle board or flake board. To mount an undercounter sink in a laminated countertop, a cross-sectional hole must be cut through the laminated surface and core. Typically, this is done by dropping a sink with an upper circumferential flange into the mounting aperture from above, and sealing the sink flange against the countertop. Because the flange is raised or bevelled, it is not possible to run a cleaning solution over it freely, since the cleaner would not run into the sink but out over the countertop. Also, water on the countop leaks into the seal between the countertop and the flange of the sink. With repeated use, the water causes deterioration of the sealing material and the mounting aperture, resulting in degradation of the laminated countertop and leakage of water into the cabinet below the countertop and onto the floor.

The present invention aims to present a novel undercounter sink and method for mounting in countertops to provide a flush surface mounting that is watertight and eliminates the problems associated with sinks and countertops in the prior art, and,also, to lessen the labor intensity in prior machining of countertops.

SUMMARY OF THE INVENTION

The present invention discloses a novel undercounter sink for installation within the aperture of a countertop. The sink is fabricated with a horizontal flange equidistant below the top rim of the sink. The flange is provided with bolt holes so that bolts may be passed therethrough to fasten the sink underneath the aperture and flush with the top of the countertop.

The present invention also discloses a novel metal collar for precisely locating the undercounter sink in the aperture. The collar has an L-shaped cross section consisting of an upstanding circumferential rib for placement within the aperture of the countertop. A horizontal rim is attached circumferentially and perpendicularly to the upstanding rib. The rim has bolt holes therein for insertion of bolts through the collar and the matching flange of the sink. When bolted to the underside of the coontertop, before mounting of the sink, the metal collar has two functons: (a) to serve as shipping and transport reinforcement for the countertop after an impervious surface has been laminated to the top of the countertop; and (b) to serve as a jig support for precise machining the impervious surface to overlap the top of the countertop for placement of the sink thereunder.

The present invention further discloses methods for: rough cutting an aperture in the countertop, positioning the novel collar within the aperture, laminating the impervious overlay surface, finish cutting the overlay so that the overlay precise-covers the top rim of the sink, inserting bolts into the underside of the countertop through the collar rim, removing the collar while retaining the bolts within the underside of the countertop, inserting the top rim of the sink within the aperture and beneath the overlay, tightening nuts onto the bolts which have been positioned through the sink flange, and sealing the top rim of the sink to the overlay so as to form a flush and watertight surface at the juncture of the countertop surface and the sink.

These and other aspects of the invention will become apparent to those skilled in the art by reference to the accompanying drawings and the below detailed description.

DETAILED DESCRIPTION

Figure 1:
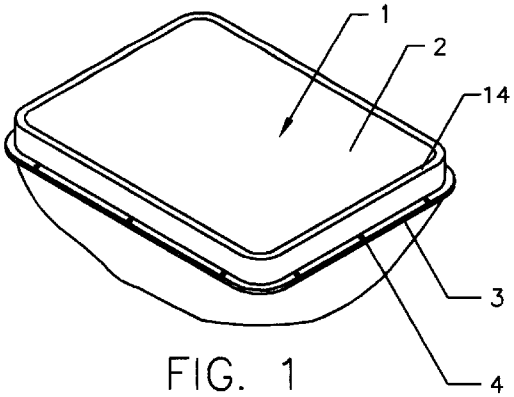
FIG. 1 is a top perspective view of the undercounter sink of the present invention.
Figure 2:
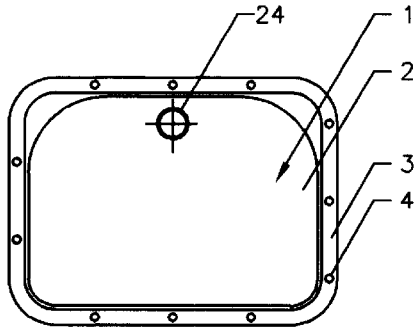
FIG. 2 is a top plan view of the undercounter sink.
Figure 3:
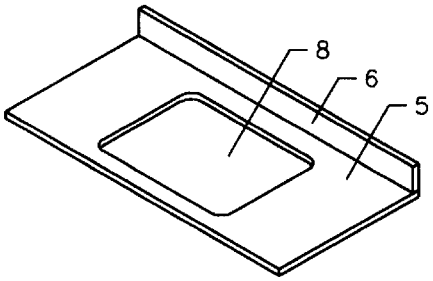
FIG. 3 is a top perspective view of the countertop of the present invention.
Figure 4:
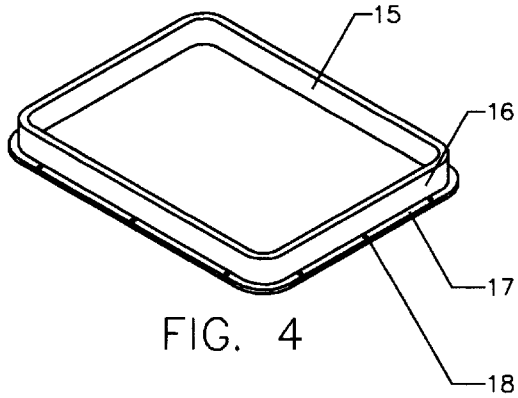
FIG. 4 is a top perspective view of the metal collar of the present invention.
Figure 5:
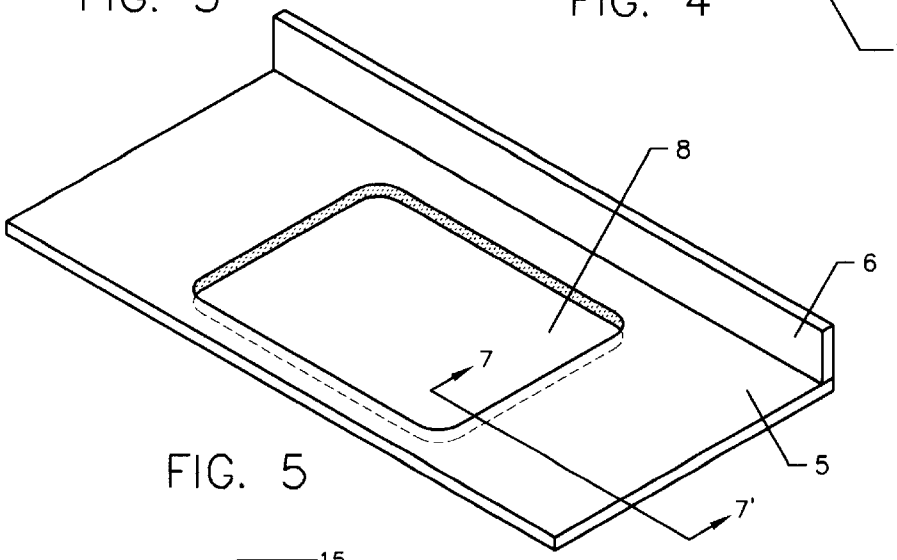
FIG. 5 is a top perspective of the countertop with the metal collar bolted in place.
Figure 6:
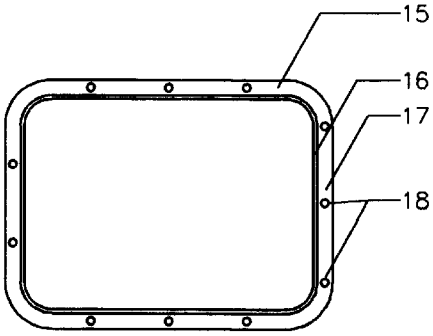
FIG. 6 is a top plan view of the metal collar showing the bolt hole pattern.

In all of the FIGS. of the accompanying drawings, the same indicating numerals refer to the same element of the present invention.

Referring now to FIGS. 1, 2, 10–13, the undercounter sink of the present invention is generally indicated as 1, and comprises a downwardly concave-shaped sink bowl 2, which is preferably manufactured of CORIAN™ material by E.I. DuPont de Nemours & Co., Wilmington, Del. The sink bowl 2 has a circumferential top sink rim 14, and a sink drain 24 at the bottom. The sink bowl 2 is manufactured with a circumferential sink flange 3 extending outwardly and horizontally at an equidistant 1 ½", aproximately, below the circumferential top rim 14. The sink flange 3 is pierced with bolt or stud holes 4 equidistant on the periphery of the flange 3.

Referring now to FIGS. 3, 5, 7–14, there is shown a typical countertop horizontal deck 5 with a splashback 6 perpendicular to and attached on the top rear of the deck 5. The deck 5 and splashback 6 consist of an underlying support member 10, aproximately 1 ½" thick, which may be made of particle board, flake board, plastic, plywood, etc. Adhered on top surface of the deck 5 is a thin overlay member 11 of impervious material which may be made of FORMICA™ material manufactured by the Formica Company, Cincinnati, Ohio.

Figure 7:
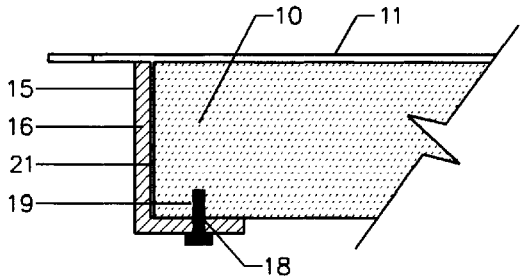
FIG. 7 is a side sectional view of FIG. 5 along line 7–7'.
Figure 8:
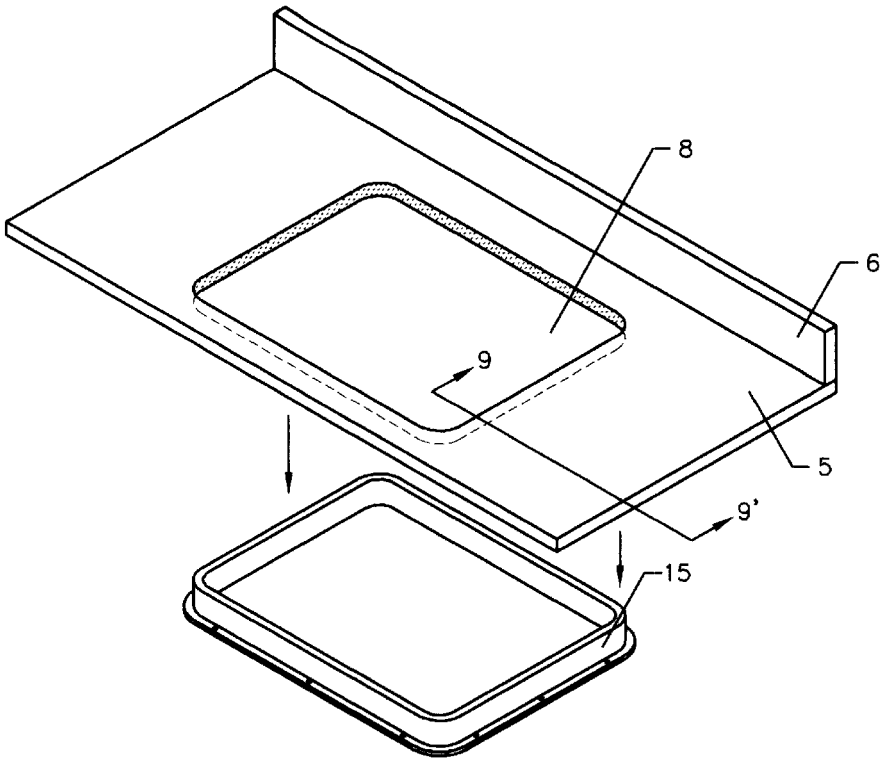
FIG. 8 is a partially exploded top perspective view of the metal collar being removed from the countertop.
Figure 9:
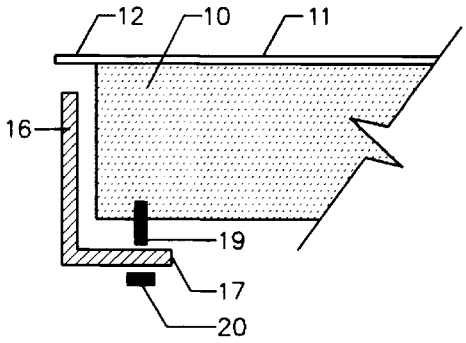
FIG. 9 is a partially exploded side sectional view of FIG. 8 along line 9–9'.
Figure 10:
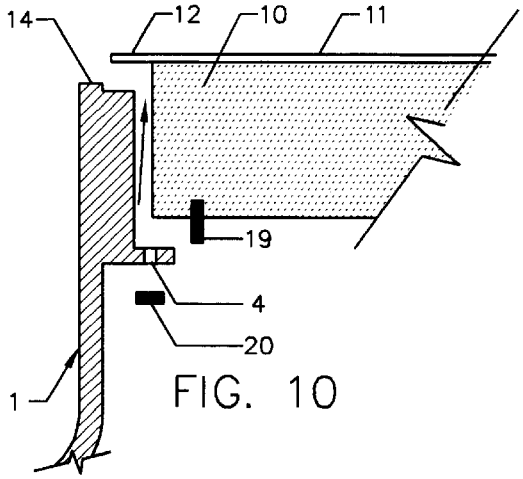
FIG. 10 is a partially exploded side sectional view of FIG. 9 showing the metal collar removed from the countertop and being replaced by the undercoater sink.
Figure 11:
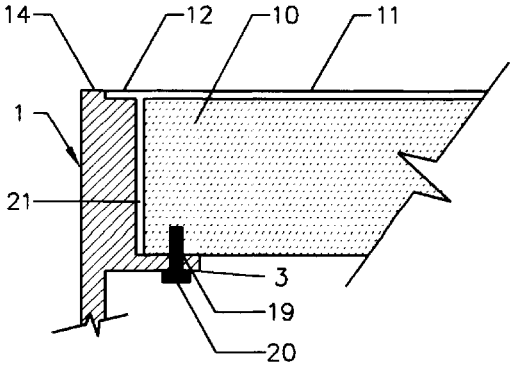
FIG. 11 is side sectional view of FIG. 9 showing the the metal collar removed from the countertop and the undercounter sink installed in the countertop.

Referring now to FIGS. 4–9, the metal collar 15 of the present invention is shown. The metal collar 15 is L-shaped in cross section and consists of an upstanding rib 16 which is circumfential to and dimensioned to fit closely around the circumferential periphery of the sink bowl 2. A circumferential rim 17 is a flat, horizontal attachment perpendicular to and outwardly from the bottom of the upstanding rib 16. The horizontal surface of the circumferential rim 17 is pierced by bolt or stud holes 18 which are spaced and dimensioned to match the stud or bolt holes 4 of the sink flange 3. As shown in FIG. 7 a bolt or stud 19 is inserted through each hole 18 of the metal collar 15 after the metal collar 15 has been placed into an aperture 8 which has previously been rough cut into the support member 10 of the countertop deck 5 at the location desired for the sink 1. After insertion of the metal collar 15 into the deck 15 and appropriate tightening of the nuts 20 onto the bolts 19, the top of the support member 10 of the countertop deck 5 is adhered or laminated to the impervious surface overlay member 11. The metal collar can now serve as a jig for a routing machine (not shown in the FIGS.) to finish cut the aperture 8 and the overlay member 11 so that the overlay member overlaps the aperture 8 inwardly by about ¼" as designated by the overhang 12. The metal collar can then serve as a reinforcement for the countertop 5, and particularly the overhang 12 during shipping, transport and handling at the sink installation site. After setting up of the countertop 5 at the desired location, the metal collar is removed as shown in FIG. 8 and 9. Thereafter the top rim 14 of the sink 1 is placed within the aperture 8 just below the overhang 12. The bolts 19 have been retained in the underside of the support member 10 after the metal collar 15 has been removed. The bolts 19 are aligned through the bolt holes 4 of the sink flange 3 and the nuts 20 are tightened onto the bolts 19 so that the sink 14 forms a tight juncture with the overhang 12 of the countertop 5 as shown in FIGS. 10 and 11. An adhesive sealant may then be applied to tight juncture with the overhang 12 to assure a watertight seal. Further, an air space 21 may be cut into the inside circumference of the aperture 8 to provide for expansion and contraction of the sink 1 within the countertop 5 during use.

Figure 12:
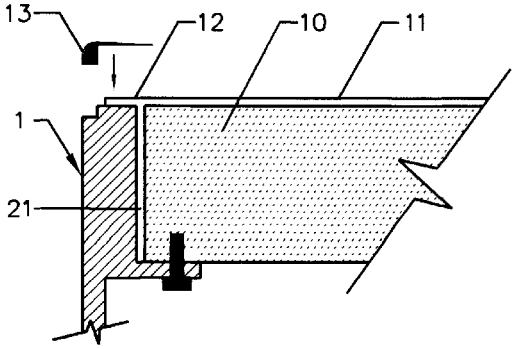
FIG. 12 is a partially exploded side sectional view of the undercounter sink being installed in the countertop with an optional decorative sealing cap.
Figure 13:
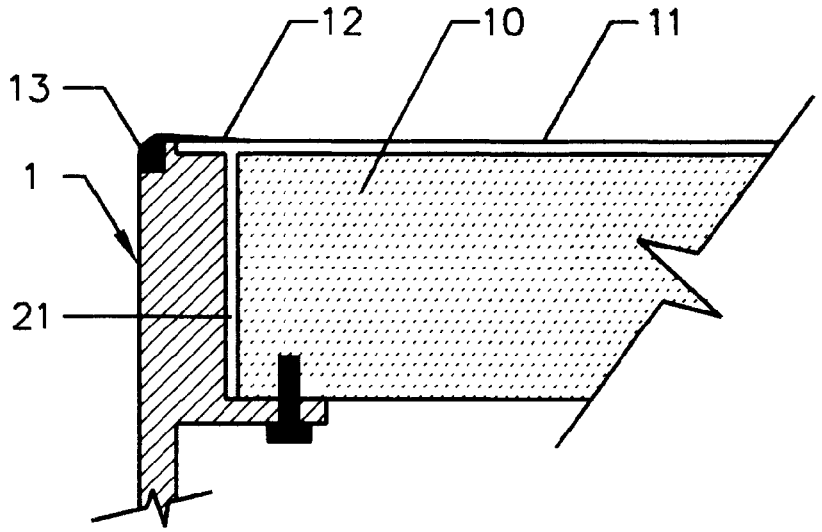
FIG. 13 is a side sectional view of FIG. 12 with the optional sealing cap installed.

Referring now to FIGS. 12 and 13, there is shown a closure cap 13 which can be applied at the tight juncture of the overang 12 with the top of the sink rim 14 so as to further assure a flush and watertight seal, and, also, a decorative appearance.

Figure 14:
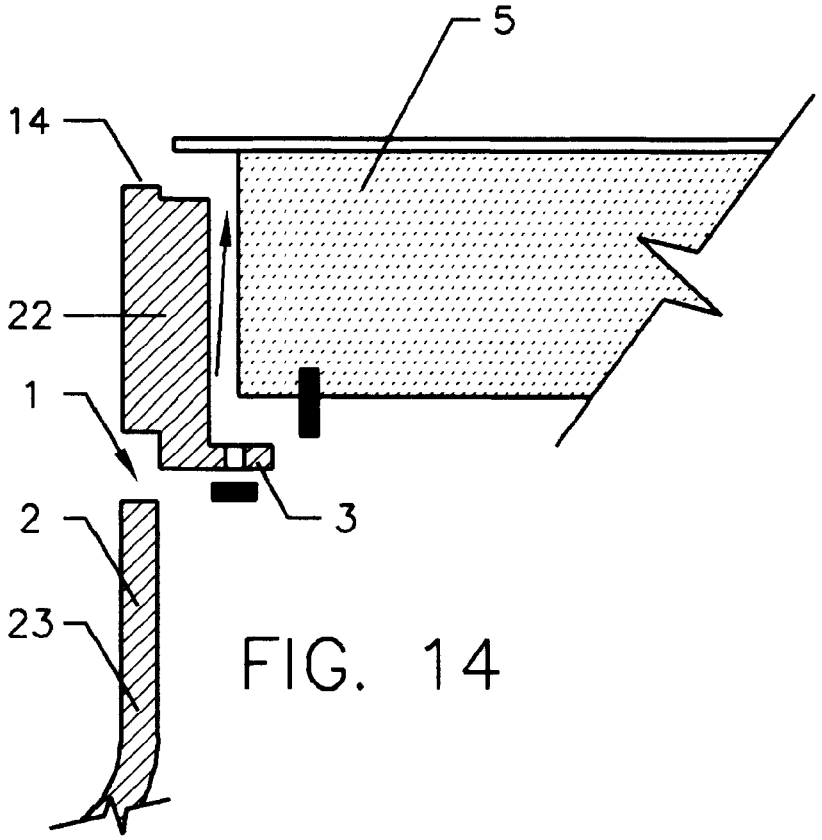
FIG. 14 is a partially exploded side sectional view of an optional two part undercounter sink.

Referring now to FIG. 14 there is shown an undercounter sink 1 which is fabricated in two parts: an upper member 22 which consists of the top rim 14 downward to the sink flange 3; and a lower member 23 which consists of the downwardly concave-shaped sink bowl 2 and bottom drain opening 24. After the sink flange 3 and top rim 14 of the upper member 22 have been secured to the countertop deck 5, the lower member 23 is placed into position below and in contact with the upper member 22 so that both the upper member 22 and the lower member 23 can be welded together at the installation. The interior of the sink bowl 2 is then sanded smooth to provide a completed undercounter sink installation. This also allows most of skilled work to be completed inshop, in lieu of at the installation site.

It will be understood that, to those skilled in the art, modifications and refinements of the present invention,as diclosed herein, may be made while still falling within the scope of the claims below.

What is claimed is:

1. A method for mounting an undercounter sink within a countertop having a horizontal support member; said sink having a downwardly shaped sink bowl, a circumferential top rim at the upper edge of said sink bowl, and a horizontal flange circumferentially attached to to the outside of the upper portion of said sink bowl, said flange is pierced with bolt holes equidistant along the periphery of said flange; said method comprising the steps of:

(a) rough cutting an aperture within said support member for said circumfential top rim of said sink bowl;

(b) positioning a removable metal collar below and within said aperture; said metal collar is L-shaped in cross section and consists of: an upstanding rib which is circumferential to and closely dimensioned to fit closely around the circumfenential periphery of said sink bowl, and a circumferentail rim of a flat horizontal atachment perpendicular to and extending outwardly from the bottom of said upstanding rib, said circumferential rim being pierced by bolt holes which are spaced and dimensioned to match the bolt holes of said flange of said sink bowl;

(c) laminating a top impervious surface overlay member to the top of said support member of said countertop;

(d) using said metal collar as a jig for finish cutting said aperture and said overlay member so that said support member precisely contains said circumferential top rim of said sink, and said overlay member overlaps slightly said top rim of said sink;

(e) inserting bolts into said support member through the bolt holes of said metal collar;

(f) removing said metal collar while retaining said bolts within said support member;

(g) positioning said top rim of said sink into said aperture below said overlap so that said bolts are aligned and pass through the matching bolt holes of said flange of said sink;

(h) tightening nuts onto said bolts so as to precisely locate and attach to the support member said sink top rim within said aperture and flush below said overlap; and (i) sealing said sink top rim and said overlap so as to form a watertight surface at the joinder of said undercounter sink and said countertop.

2. The method for mounting an undercounter sink within a countertop, as recited in claim 1, which further comprises an additonal step of placing a circumferential cap over said sink top rim and said overlap so as to further assure a watertight surface at the joinder of said undercounter sink and said countertop.

3. The method for mounting an undercounter sink wit a countertop, as recited in claim 1, which further comprises an additional step of using said removable metal collar as a reinforcement of said aperture and of said overlay during the shipping, handling and transport of the countertop before the step of removing said collar.

* * * * *